US007752968B2

(12) United States Patent
Fuchs

(10) Patent No.: US 7,752,968 B2
(45) Date of Patent: Jul. 13, 2010

(54) METHOD AND DEVICE FOR DETERMINING THE POSITION OF A MARK OF A CONTINUOUS SUPPORT MATERIAL

(75) Inventor: Werner Fuchs, Munich (DE)

(73) Assignee: Oce Printing Systems GmbH, Poing (DE)

( * ) Notice: Subject to any disclaimer, the term of this patent is extended or adjusted under 35 U.S.C. 154(b) by 684 days.

(21) Appl. No.: 11/573,373

(22) PCT Filed: Aug. 11, 2005

(86) PCT No.: PCT/EP2005/008762

§ 371 (c)(1),
(2), (4) Date: Feb. 7, 2004

(87) PCT Pub. No.: WO2006/018234

PCT Pub. Date: Feb. 23, 2006

(65) Prior Publication Data

US 2007/0248367 A1 Oct. 25, 2007

(30) Foreign Application Priority Data

Aug. 11, 2004 (DE) ..... 10 2004 039 045

(51) Int. Cl.

| | |
|---|---|
| ***B41F 1/34*** | (2006.01) |
| ***B41F 21/12*** | (2006.01) |
| ***B41F 21/14*** | (2006.01) |
| ***B41F 13/54*** | (2006.01) |
| ***B41L 1/02*** | (2006.01) |
| ***B41J 11/00*** | (2006.01) |
| ***B23Q 15/00*** | (2006.01) |
| ***B23Q 16/00*** | (2006.01) |
| ***B65H 43/00*** | (2006.01) |
| ***G03G 15/00*** | (2006.01) |

(52) U.S. Cl. ..... 101/485; 101/228; 400/583; 226/12; 399/384

(58) Field of Classification Search ..... 101/228, 101/225, 227, 224, 485, 483; 400/583, 611, 400/613.2, 613.1; 226/12, 28, 24, 27, 45; 399/384

See application file for complete search history.

(56) References Cited

U.S. PATENT DOCUMENTS

| | | | | |
|---|---|---|---|---|
| 4,512,256 | A * | 4/1985 | Schriber et al. | 101/248 |
| 4,734,868 | A | 3/1988 | DeLacy | |
| 4,839,674 | A * | 6/1989 | Hanagata et al. | 346/136 |

(Continued)

FOREIGN PATENT DOCUMENTS

| | | |
|---|---|---|
| DE | 103 12 162 | 10/2004 |

(Continued)

*Primary Examiner*—Judy Nguyen
*Assistant Examiner*—Leo T Hinze
(74) *Attorney, Agent, or Firm*—Schiff Hardin LLP

(57) ABSTRACT

In a method and device for determination of a marking of an endless carrier material relevant for positioning of the endless carrier material to be printed in a printer or copier, the endless carrier material is inserted into the printer or copier. The endless carrier material is positioned in the printer or copier such that the marking is arranged in a detection region of a sensor arrangement. The pointing device is positioned at a position of the marking relevant for the positioning of the carrier material in the printer or copier. The position of the positioned pointing device is detected with aid of the sensor arrangement.

17 Claims, 4 Drawing Sheets

U.S. PATENT DOCUMENTS

| | | | | |
|---|---|---|---|---|
| 4,947,217 | A * | 8/1990 | Murakami et al. | 399/394 |
| 5,172,138 | A * | 12/1992 | Okazawa et al. | 346/134 |
| 5,929,894 | A | 7/1999 | Kikuchi | |
| 6,175,716 | B1 * | 1/2001 | Toyama et al. | 399/384 |
| 6,256,474 | B1 | 7/2001 | Gibisch et al. | |
| 6,292,649 | B1 | 9/2001 | Toyama et al. | |
| 6,402,405 | B1 * | 6/2002 | Frodl et al. | 400/582 |
| 6,817,795 | B2 * | 11/2004 | Korthauer | 400/613 |

FOREIGN PATENT DOCUMENTS

| | | |
|---|---|---|
| EP | 0 443 590 | 8/1991 |
| EP | 37 51 364 | 3/1996 |

* cited by examiner

METHOD AND DEVICE FOR DETERMINING THE POSITION OF A MARK OF A CONTINUOUS SUPPORT MATERIAL

BACKGROUND

The preferred embodiment concerns a method and a device for determination of the position of a marking of an endless carrier material, the marking serving as a referencing for which the endless carrier material is inserted into a printer or copier to determine a position thereof.

In particular in high-capacity printers with a print speed of greater than 150 sheets of DIN A4 per minute, markings are detected with aid of sensor arrangements in the printer or copier to position print images on the endless carrier material. For example, margin holes provided in a margin region of the carrier material are detected with aid of what are known as hole sensors. Alternatively or additionally, marks pre-printed on the carrier material can be detected with aid of a sensor arrangement (in particular with the aid of a mark sensor) in the printer or copier. With aid of the detected position of such a marking, at least one further position is determined with aid of a control unit of the printer, in particular dependent on a preset form length. The position of a transverse fold present in the carrier material is advantageously determined. The marking or the determined position is positioned at a desired position with aid of the determined position in order to exactly position a print image on the carrier material starting from this desired position.

In order to be able to exactly position further positions on the carrier material (in particular a transverse fold in the carrier material) at a desired position, it is required to detect the position of the transverse fold in relation to the detectable margin holes and/or in relation to the detectable pre-printed marks in order to be able to exactly determine and position the exact bearing of the carrier material in the printer or copier as well as the bearing of further positions, in particular further transverse folds in the carrier material. Workflows are controlled and/or error states are monitored with aid of the detected positions of a marking in the printer or copier.

Given a known high-capacity printer of the model CB by the applicant, a paper web 16 serving as a carrier material is positioned at a position marking after the insertion. As shown in FIG. 1, the position marking is an edge of a guide 12 transverse to the primary transport direction of the paper web 16 that is fastened to a pivotable device 14 such that the guide 12 can be pivoted towards the paper web 16 in the direction of the arrow P1 with the aid of the pivot device 14. In the downward-pivoted state, the lower edge of the guide 12 contacts the surface of the paper web 16 or is arranged directly above the paper web 16 in order to avoid measurement or positioning errors. The paper web 16 is supplied to the printer in the direction of the arrow P2, whereby the direction specified by the arrow P2 is the primary transport direction in which the paper web 16 is supplied to the printer for printing.

The edge of the guide 12 (visible in the downward-pivoted state on the paper web 16) forms the position marking on which a marking applied on the paper web 16 must be exactly aligned in order to implement what is known as a synchronization procedure starting from this position. Given such a synchronization procedure the paper web 16 is conveyed in the direction of the arrow P2 until a marking is detected with the aid of a sensor arrangement arranged in the printer. The further positioning of the paper web 16 in the printer is controlled starting from the length of the paper web 16 transported until the arrival of the marking at the sensor arrangement and the real position of the paper web 16 upon arrival of the marking at the sensor arrangement.

In the present case the paper web 16 comprises a transverse fold 18 that is designed as a perforation in the paper web 16 and forms a separation point between two adjoining, printable forms. The forms are segments of the paper web 16 to be printed, which segments establish the length of a single sheet, for example, given a further processing of the paper web 16.

For positioning of the transverse fold 18, with the aid of operator inputs by an operation personnel the paper web 16 is conveyed back and forth via slow forward transport of the paper web 16 in the direction of the arrow P2 and/or a slow transport of the paper web 16 in the direction opposite the arrow P2 until the transverse fold 18 is exactly aligned on the straight edge of the guide 12. This procedure is relatively elaborate and requires of the operating personnel a great deal of practice and skill. Alternatively or additionally, a marking can be printed on the paper web 16, which marking is also designated as a mark. The mark, similar to the margin holes, is then detected with the aid of a sensor arrangement in the printer or copier, whereby the arrival of the leading or trailing mark edge at the sensor arrangement is advantageously detected and used to control the positioning of the paper web 16.

Furthermore, in FIG. 1 a second transverse fold 20 is shown that, like the first transverse fold 18, is formed as a perforation in the paper web 16. The region between the first transverse fold 18 and the second transverse fold 20 is a print region of a first form.

The paper web 16 with the transverse folds 18 and 20 according to FIG. 1 is shown in FIG. 2. Identical elements have identical reference characters. A first mark 22 in the form of a printed rectangle is shown on the paper web 16. The first mark is arranged immediately after (in relation to the primary transport direction P2 of the paper web 16) the transverse fold 18 in the left margin region of the paper web 16. Given a further processing of the printed paper web 16, this margin region is, for example, cut off or is located in a margin region that is not visible after the binding of a plurality of print pages. A second mark 24 in the form of a rectangle printed on the paper web 16 is arranged immediately after the second transverse fold 20 in the running paper direction P2.

The transverse folds 18 and 20 demarcate a first print region that is also designated as a form, whereby the interval between the transverse folds 18 and 20 is also designated as a form length, A second print region follows the first print region after the transverse fold 20, which second print region has the same form length as the first print region. The second mark 24 is arranged immediately after the second transverse fold 20 and has the same bearing relative to the transverse fold 20 and relative to the left edge of the paper web 16 as the first mark 22 has relative to the transverse fold 18 and to the left edge of the paper web 16.

Starting from the size of the printed marks 22 and 24, a detection range of a sensor arrangement in the printer or copier is provided that, in what is known as a detection window, scans the paper web 16 and determines whether and, if applicable, when a mark edge enters into this detection window at the sensor arrangement. This window is designated with 26 for the first mark 22 in FIG. 2 and with 28 for the second mark 24. However, the window merely specifies the region of the paper web that is scanned with the aid of the sensor arrangement on the basis of the dimensions and position of the marks 22, 24 and is thus visible on the paper web 16 neither before nor after the printing.

After the insertion of the paper web 16 into the printer, the leading mark edge is to be exactly aligned on the straight edge of the guide 12 via slow forward and/or backward movement of the paper web 16. The operating personnel must subsequently measure the bearing and width of the mark 24 aligned on the guide, which mark is transverse to the primary transport direction P2, and input the bearing and width into the printer via a control panel. The sensor arrangement for detection of the mark in the printer is then correspondingly displaced transverse to the primary transport direction such that the mark 24 is detected from the detection region of the sensor arrangement upon passage of the paper web 16 through the printer.

Alternatively or additionally, the detection region of the sensor arrangement can be adapted in the y-direction to the position of the mark 24. The interval between the mark edge facing towards the transverse fold 18 and the transverse fold 18 is also preset as a parameter in the printer, for example via an input by an operating personnel via an input unit. The interval between the transverse fold 18 and the transverse fold 20 (i.e. the form length) or the interval between the leading edge of the first mark 22 and the leading edge of the second mark 24 is also likewise preset as a parameter via an input by the operating personnel.

Primarily the exact positioning of the marking to be detected (i.e. of the mark 24 or of the transverse fold 18) at the guide 12 and the exact dimensioning of the width and the bearing of the mark 24 is quite elaborate and requires a relatively large amount of time even given trained expert personnel. Errors upon measurement and input of the values read off at the guide 12 can also occur.

Alternatively, the marks 22 and 24 can be arranged at an arbitrarily different point of each form. For example, the marks 22 and 24 can be used as graphical elements for the overall print image to be generated and in particular can be components of a logo.

Arrangements that detect position markings provided on a carrier material to be printed are known from the documents U.S. Pat. No. 6,292,649 B1, U.S. Pat. No. 6,256,474 B1, U.S. Pat. No. 5,929,894 and EP 0 443 590 A1.

SUMMARY

It is an object to specify a method and a device that determine in a simple manner a marking of the carrier material that is relevant for the positioning of an endless carrier material to be printed in the printer or copier and given which errors are avoided.

In a method and device for determination of a marking of an endless carrier material relevant for positioning of the endless carrier material to be printed in a printer or copier, the endless carrier material is inserted into the printer or copier. The endless carrier material is positioned in the printer or copier such that the marking is arranged in a detection region of a sensor arrangement. The pointing device is positioned at a position of the marking relevant for the positioning of the carrier material in the printer or copier. The position of the positioned pointing device is detected with aid of the sensor arrangement.

DESCRIPTION OF THE PREFERRED EMBODIMENT

Figure 1:
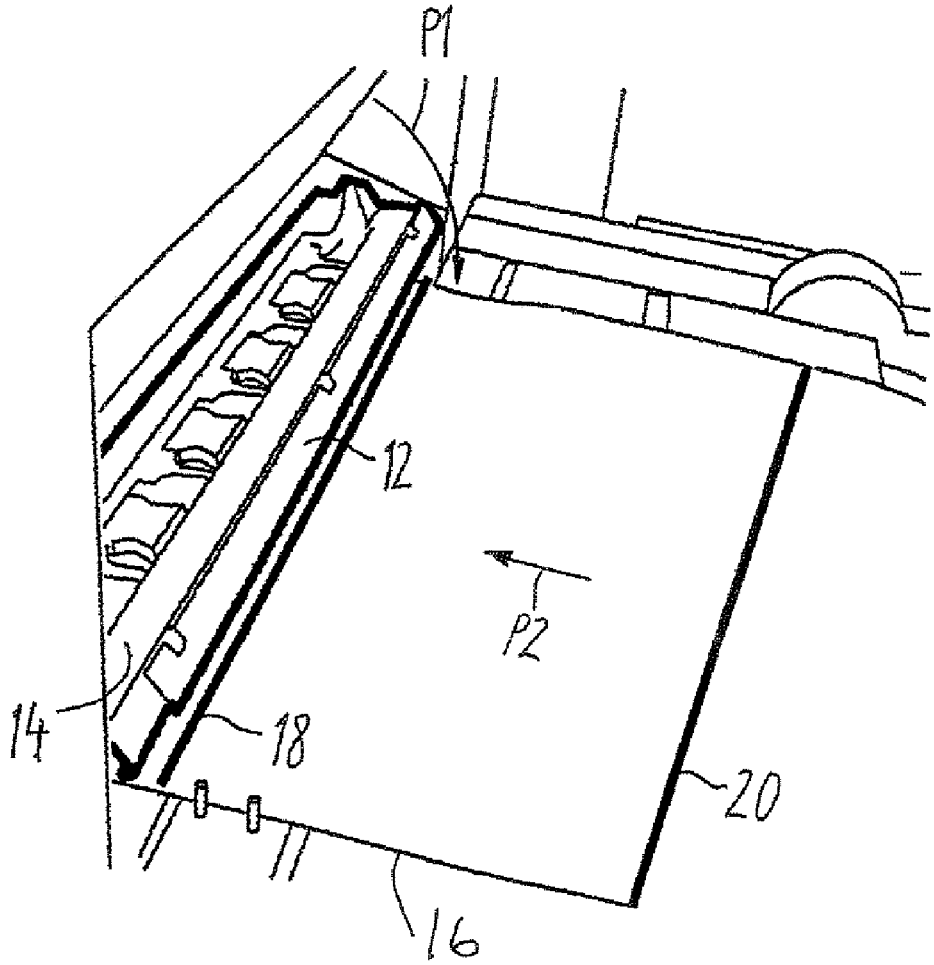
Fig. 1 (PRIOR ART)
FIG. 1 is a perspective representation of the paper feed of a high-capacity printer.

For the purposes of promoting an understanding of the principles of the invention, reference will now be made to the preferred embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Via the method of the preferred embodiment, a pointing device is positioned in a simple manner at the relevant position of the marking and the position of the pointing device is detected. A simple and assured determination of the position of the marking is thereby possible, whereby errors in the detection are precluded to the greatest possible extent. An exact adjustment of the paper web is also no longer required due to the positioning of the pointing device. The detection of the relevant position of the marking in a relatively large range is possible dependent on the detection region of the sensor arrangement. The determination of the position advantageously also comprises the transfer of the position detected with the aid of a sensor arrangement to a control unit of the printer or copier.

A second aspect of the preferred embodiment concerns a device for determination in the printer or copier of a marking of the carrier material that is relevant for the positioning of an endless carrier material to be printed. The device has a sensor arrangement in which is arranged a detection region of the marking of the endless carrier material inserted into the printer or copier. The device also has a pointing device that can be positioned at a position of the marking that is relevant for the positioning of the carrier material in the printer or copier. The sensor arrangement detects the position of the positioned pointing device.

Via this device it is possible to detect the position of the marking in a simple manner. The positioning of the pointing device on the marking or at the relevant position of the marking is quick and possible without great effort, whereby the determination of the position occurs relatively quickly and without error. A highly precise alignment of the marking at the printer or copier as in the prior art is not required in the device of the preferred embodiment. The position determined with the aid of the sensor arrangement can also be transferred to a control unit of the printer or copier and be further processed by this control unit, whereby errors in the reading and in the input of the position are avoided.

Figure 2:
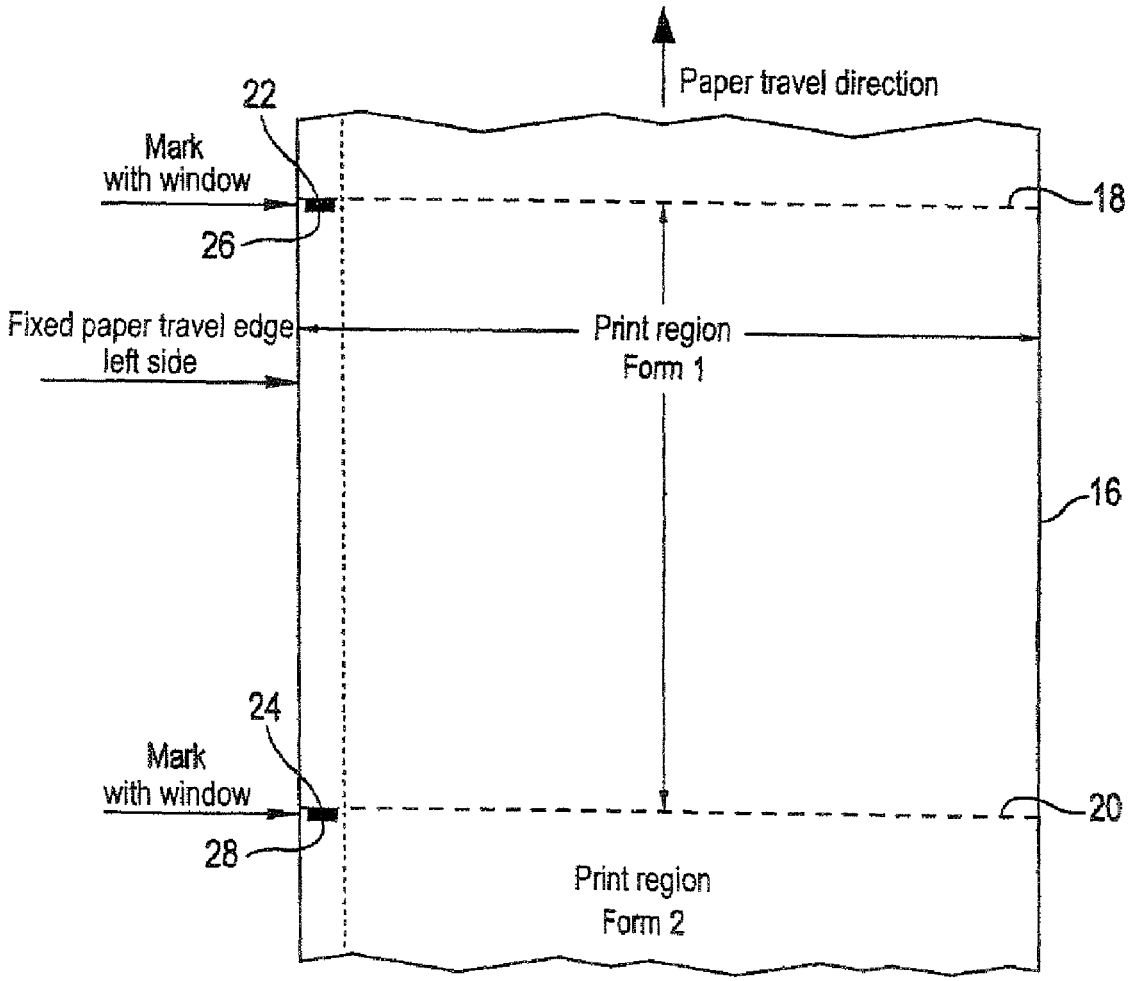
FIG. 2 (PRIOR ART)
FIG. 2 is a section of an endless paper web to be printed, with printed markings.
Figure 3:
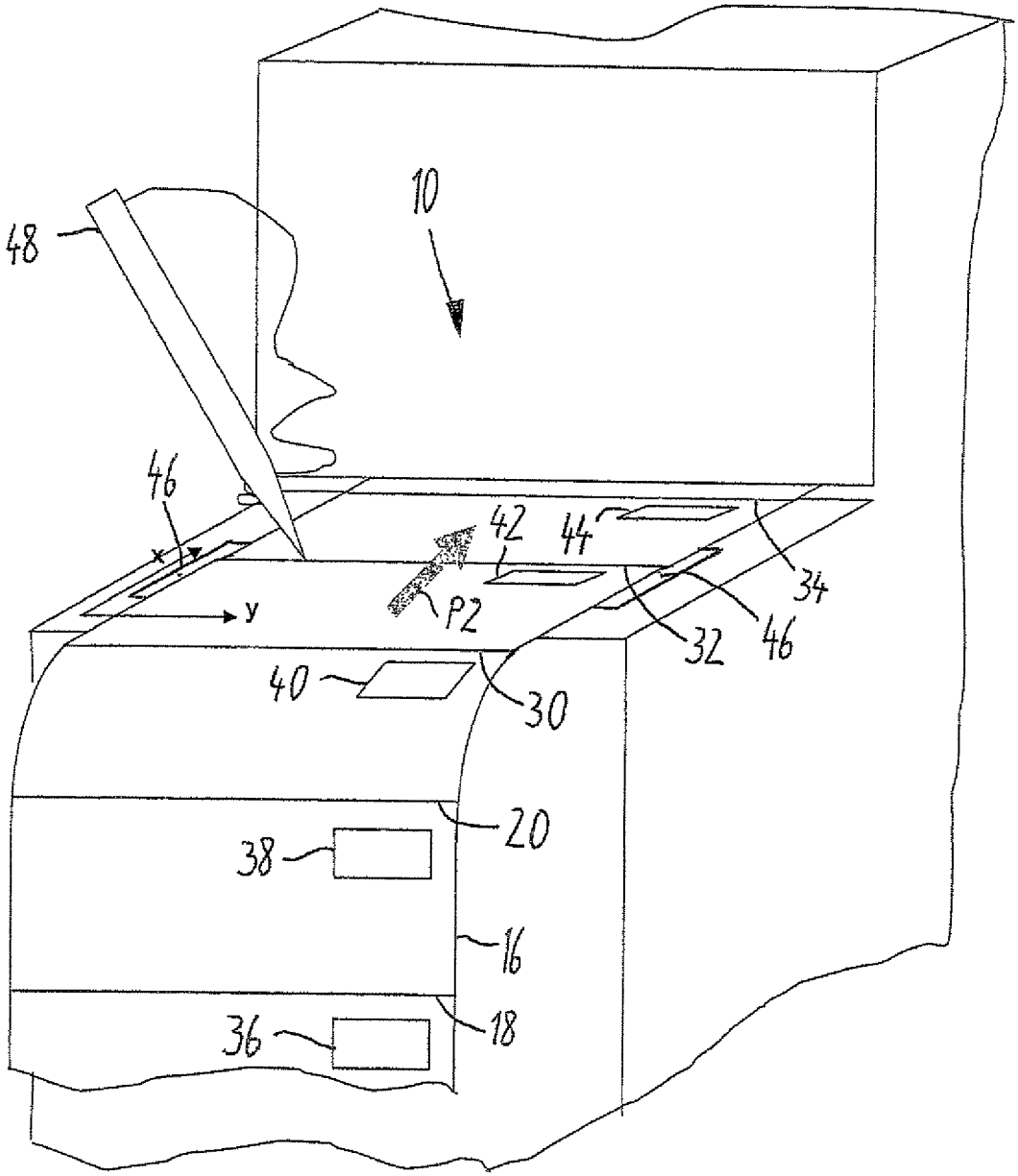
FIG. 3 is a schematic representation of a paper feed of a high-capacity printer according to the preferred embodiment.

Shown in FIG. 3 is a section of a high-capacity printer of the preferred embodiment that has a design similar to the known high-capacity printer already described in the specification preamble in connection with FIG. 1. Identical elements have the same reference characters. A paper web 16 is supplied to a paper feed 10 of the high-capacity printer in the direction of the arrow P2. The paper web 16 is supplied to the paper feed 10 of the printer from, for example, a stack or a paper roll (not shown). In contrast to the marks shown in FIG. 2, given the paper web 16 according to FIG. 3 larger marks are printed on the paper web 16 that, as graphical elements, are components of the print image (in particular of a company logo).

As already explained in connection with FIG. 2, transverse folds 18, 20, 30, 32, 34 divide the endless paper web 16 into print regions with the same form length. Each of these segments comprises a respective marking 36, 38, 40, 42, 44 that respectively has the same dimensions and the same position in the print region. Each of the markings 36 through 44 thus has the same dimensioning and position in the y-direction and the same separation from an adjacent transverse fold 18, 20, 30, 32, 34.

A touch-sensitive sensor surface 46 is arranged below the paper web 16 inserted into the printer. The sensor surface 46 advantageously forms a common planar surface with the adjacent surfaces in the entrance region of the paper feed 10, such that the paper web 16 at the entrance of the paper web 16 can slide over the sensor surface 46 without problems into the printer. Alternatively, measurement methods with the aid of magnetic fields, inductive measurement methods or potentiometric measurement methods as well as ultrasonic methods can also be used, given which the respective sensor arrangement can also be arranged below a cover plate through which an input with the aid of a pointing device is possible without problems. The sensor arrangement is thereby then not necessarily touch-sensitive in the sense of the word.

For automatic adjustment of a sensor for detection of the markings 36, 38, 40, 42, 44 in a printer that detects the marking for paper travel control, it is in particular necessary that the y-dimension and the y-position of the marks 36 through 44 is known exactly. Furthermore, for exact positioning of the print images it is required that the interval between the marking 42 and the adjacent transverse fold 32 is known exactly. After the insertion, an operating personnel moves the paper web 16 in the x-direction with the aid of control inputs such that the transverse fold 32 and the marking 42 lie on the sensor surface 46. An exact positioning of the transverse fold 32 and/or of the marking 42 in a determined region of the sensor surface 46 is not required for this. Alternatively, an advancement of the paper web 16 via a control input by an operating personnel can occur between the detection of the position of the transverse fold 32 and the position of the marking 42, whereby the path of the paper web 16 covered given the advancement is detected and taken into account in the position determination.

With the aid of a pointing device, the operating personnel traces both the position of the transverse fold 32 and the outline of the marking 42. In the exemplary embodiment according to FIG. 3 the pointing device is a pen (that is also designated as a stylus) and that is shown enlarged in FIG. 3. The pen 48 is designed complementary to the sensor surface 46 of the sensor arrangement. Given a pressure-sensitive surface such as, for example, a glide pad with an optical, a capacitive or an ultrasonic measurement method, any pen can be used via which the operating personnel can exert a pressure through the paper web 16 onto the sensor surface 46.

Given other measurement methods, in particular given an inductive measurement method or given a measurement method with the aid of a magnetic field, it can be required that the pen comprises a specific material or a circuit arrangement. An input button can additionally be arranged on the pen 48, via which input button the position of the pen 48 can be detected even when this exerts no pressure on the sensor surface 46 or the paper web 16. Other pointing devices such as, for example, light styli or a crosshair (what is known as a lens mouse) can also be used. As already mentioned, the position of markings required for positioning of the paper web 16 is taken with the aid of the respective pointing device 48.

In the exemplary embodiment according to FIG. 3, as already mentioned the transverse fold 32 is marked with the aid of the pen 48 in that a sub-region of the transverse fold 32 is traced with the pen 48. The outline of the marking 42 is also traced with the aid of the pen 48. A control unit (not shown) of the printer detects the positions of the transverse fold 32 and the marking 46 input via the sensor surface 46 and, with the aid of these determined positions, determines the orientation of the marking 42 relative to the printer and the orientation of the paper web 16 in the printer. Furthermore, the control unit determines the orientation and the extent of the marking 42 in the y-direction via the input of the outline of the marking 42.

As already mentioned in connection with FIGS. 1 and 2, at least one further sensor arrangement that detects the arrival of (advantageously) the leading edge of the markings 36 through 44 is provided in the printer, whereby the position of the paper web 16 in the printer and/or the transfer printing time of print images onto the paper web 16 is controlled starting from the detected mark edge. The detection region of this sensor arrangement is, for example, 0.8 mm in the x-direction and 4 mm in the y-direction. The markings 36 through 44 can be arranged at any arbitrary point on the form between two transverse folds 32, 30, in particular when they are integrated as a graphical element into the print image to be generated. In order to be able to detect the marking 42 at each point, the sensor arrangement for detection of the marking 42 is arranged such that it can be displaced in the y-direction. Based on the outline of the marking 42 input with the aid of the sensor arrangement 46, the control unit determines a suitable position of the sensor arrangement for detection of the marking 42 in the y-direction and moves this sensor arrangement into this suitable position with the aid of an actuator.

In a preferred embodiment, the sensor surface is illuminated such that markings that are printed on the back side of the paper web 16 appear through the paper web 16, whereby at least the outlines of these markings are visible for an operating personnel from the top side of the paper web 16 shown in FIG. 3 and can be marked with the aid of the pointing device 48. The sensor surface has at least the width of a maximum paper web width printable with the aid of the printer. The touch-sensitive sensor surface can also be comprised of sub-regions that border on one another. A high-resolution graphic tablet with suitable dimensions is advantageously used as a sensor surface 46.

Figure 4:
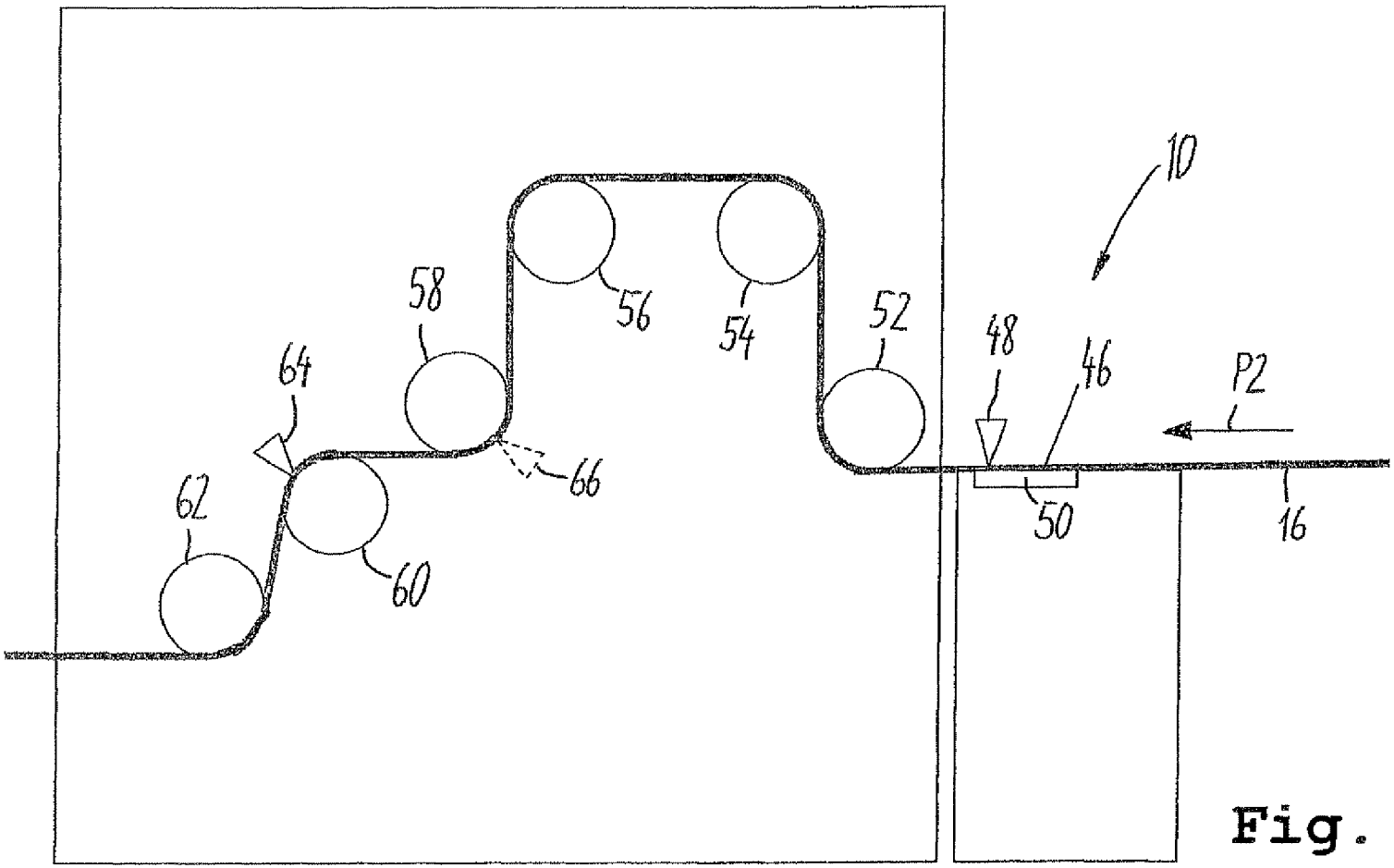
FIG. 4 is a schematic section representation of the high-capacity printer according to FIG. 3, whereby the paper web to be printed and the paper transport path through the printer are shown.

A section representation of the printer of the preferred embodiment is shown in FIG. 4, in which section representation some elements of the paper direction are merely shown schematically. As already explained in connection with FIG. 3, a sensor arrangement 50 (in particular a graphic tablet) has been embedded into the surface of the paper feed 10 in the region of the paper feed 10. Given the transport in the direction of the preferred embodiment P2, the paper web 16 is conveyed across the sensor surface 47 into the printer. A position of the paper web 16, in particular the position of a marking contained on the paper web 16, can be traced and thereby input with the aid of the pointing device 48.

Alternatively, a point input is also possible. Given a point input the tracing of outlines or, respectively, of lines is omitted. For example, vertices of the marking 42 and/or two points on the transverse fold 32 can thus also be input with the aid of the pointing device 48. The paper web 16 is directed through the printer via a plurality of deflection rollers 52 through 56, whereby the position of the marking 42 and of the further markings 36, 38, 40 and 44 printed on the top side of the paper web 16 are detected with the aid of a sensor arrangement 64. After the position of the marking 42 has been input with the aid of the pointing device 48 and detected by the sensor arrangement 50, the paper web 16 is conveyed in the direction of the arrow P2 during an initialization procedure until the leading edge of a marking 44 arrives at the sensor arrangement 64.

As already explained, the sensor arrangement 64 is aligned in the y-direction according to FIG. 3 such that it detects the arrival of the markings 36 through 44. Upon arrival of a mark edge, this position of the paper web 16 is then used as an initialization position (i.e. as a starting position) for the further transport of the paper web 16 through the printer, in particular for positioning of the paper web 16 during the print process. Starting from this position, the paper web 16 is moved to a desired position that serves as an initial position for a printing process. The paper web 16 is subsequently started from this desired position at a predetermined point in time before the transfer printing of a print image on this paper web 16.

If, as already explained in connection with FIG. 3, a marking is present on the back side of the paper web 16 and the position of this marking has been detected with the aid of the sensor arrangement 50, a sensor arrangement 66 for detection of the arrival of the leading edge of this marking (arranged on the back side of the paper web 16) at the sensor arrangement 66 can thus be as an alternative to or in addition to the sensor arrangement 64. With the aid of this sensor arrangement 66 the positioning of the paper web 15 and the print process can be controlled in the same manner as with the aid of the sensor arrangement 64. Starting from the described initialization position, upon arrival of the leading edge of the marking 44 at the sensor arrangement 64 all further positions of the further transverse folds 18, 20, 30 through 34 can be determined by the control unit of the printer and the further markings 36 through 42 can be determined. As an alternative to the movable sensor arrangements 64, 66, a sensor arrangement with a detection region across the entire paper web width that can be processed in the printer can also be provided, whereby starting from the position detected with the aid of the sensor arrangement 50 a sensor region made up of this entire sensor region is selected. The arrival of markings is monitored in this entire sensor region.

Furthermore, only edges of markings that are detected in a specific time window (i.e. markings arranged at a specific point given a preset transport speed of the paper web 16) are detected with the aid of the sensor arrangements 64 and 66. As an alternative to the markings 36 through 44, margin holes arranged in a margin region of the paper web 16 can also be marked and thus their position can be detected exactly with the aid of the sensor arrangement 50. If, for example, the outlines of two successively-arranged arranged margin holes are input with the aid of the pointing device 48 and the position of a transverse fold is arranged between these margin holes, the bearing of the transverse fold relative to these margin holes can be determined very simply and precisely by the control unit of the printer.

As an alternative to the arrangement shown in FIG. 4, an arrangement for detection of the position of the pointing device 48 can also be provided, which arrangement is arranged above the paper web but can exactly determine the bearing of the pointing device 48 relative to the printer.

Although a preferred exemplary embodiment has been shown and described in detail in the drawings and in the preceding specification, it should merely be viewed as purely exemplary and not as limiting the invention. It is noted that only the preferred exemplary embodiment is shown and described, and all variations and modifications that presently and in the future lie within the protective scope of the invention should be protected.

I claim as my invention:

1. A method for determining a position of a marking of an endless carrier material to be printed relevant for a positioning of the endless carrier material in a printer or copier where the carrier material is to be printed, comprising the steps of:

inserting the endless carrier material into the printer or copier;

positioning the endless carrier material in the printer or copier such that the marking is arranged in a detection region of a sensor arrangement;

positioning a pointing device at a position of the marking relevant for the positioning of the carrier material in the printer or copier; and detecting a position of the positioned pointing device with aid of the sensor arrangement.

2. A method according to claim 1 wherein at least one further position relevant for positioning of the carrier material is determined with aid of the determined position of the pointing device.

3. A method according to claim 2 wherein the carrier material is positioned in the printer or copier with aid of the detected position and/or with aid of the determined further position such that the detected position and/or the determined further position is automatically positioned at a desired position in the printer or copier without further control actions.

4. A method according to claim 1 wherein the detected position and/or the determined further position is positioned at a desired position with aid of a further marking.

5. A method according to claim 1 wherein an arrival of the marking and/or of a further marking is detected with aid of a second sensor arrangement arranged in the printer or copier.

6. A method according to claim 5 wherein a detection region of the second sensor arrangement is adjusted transverse to a transport direction of the carrier material dependent on the determined position of the marking.

7. A method according to claim 5 wherein the second sensor arrangement is arranged such that it can be displaced transverse to a transport direction and is displaced transverse to the transport direction with aid' of an actuator such that the marking is detected upon passing by the second sensor arrangement.

8. A method according to claim 1 wherein a transverse fold, a marking hole, and/or a mark already printed on the carrier material is utilized as said marking, and an established region, an established point, and/or an outline of the marking is detected.

9. A method according to claim 1 wherein the position of the marking is detected with aid of said sensor arrangement which is touch-sensitive.

10. A method according to claim 9 wherein the sensor arrangement has at least two equally large detection regions adjoining one another, so that the carrier material abuts on a touch-sensitive planar surface of the sensor arrangement, and the position of the marking to be identified is input with aid of the pointing device.

11. A method according to claim 1 wherein the position of the marking is detected with aid of a potentiometric measurement, a magneto-mechanical measurement, a capacitive measurement, an inductive measurement, an optical measurement, ultrasound, and/or a magnetic field.

12. A method according to claim 1 wherein a measurement arrangement is provided for implementation of a measurement, and/or a graphic tablet, a glide pad, a touchscreen, a light barrier matrix, and/or a light stylus is used as the sensor arrangement.

13. A method according to claim 1 wherein the carrier material is illuminated on its side facing away from an operating personnel at least during the detection of the marking.

14. A method according to claim 1 wherein the positioning of the carrier material for arrangement of the marking in a detection region of the sensor arrangement occurs with aid of operating inputs of an operating personnel via a control panel of the printer or copier, so that the carrier material is slowly transported backwards and forwards in relation to a primary transport direction thereof with aid of the operating inputs.

15. A method according to claim 1 wherein an operating personnel directs the pointing device to the position of the marking to be identified.

16. A device for determining a position of a marking of an endless carrier material to be printed relevant for a positioning of the endless carrier material inserted in a printer or copier where the endless carrier material is to be printed, comprising:

a sensor arrangement having a detection region in which is arranged the marking of the endless carrier material inserted into the printer or copier;

a pointing device positioned at a position of the marking relevant for the positioning of the carrier material in the printer or copier; and the sensor arrangement detecting a position of the positioned pointing device.

17. A method for determining a position of a marking of an endless carrier material to be printed relevant for positioning of the endless carrier material in a printer or copier where the endless carrier material is to be printed, comprising the steps of:

inserting the endless carrier material into the printer or copier;

positioning the endless carrier material in the printer or copier such that the marking is arranged in a detection region of a sensor arrangement, said sensor arrangement being pressure sensitive to detect pressure of a pointing device, and said sensor arrangement having a width at least substantially equal to or greater than a width of the carrier material;

positioning a pointing device at the marking for use in positioning the carrier material in the printer or copier; and detecting a position of the positioned pointing device with aid of the sensor arrangement.

* * * * *